US010689232B2

(12) United States Patent
Pfeiler et al.

(10) Patent No.: US 10,689,232 B2
(45) Date of Patent: Jun. 23, 2020

(54) FLOOR COVERING OF A PASSENGER CONVEYOR

(71) Applicant: INVENTIO AG, Hergiswil (CH)

(72) Inventors: Alexander Pfeiler, Vienna (AT); Gerhard Kleewein, Pressbaum (AT); Manfred Gartner, Felixdorf (AT); Georg Wagenleitner, Vienna (AT)

(73) Assignee: Inventio AG, Hergiswil (CH)

( * ) Notice: Subject to any disclaimer, the term of this patent is extended or adjusted under 35 U.S.C. 154(b) by 26 days.

(21) Appl. No.: 16/303,856

(22) PCT Filed: May 11, 2017

(86) PCT No.: PCT/EP2017/061391
§ 371 (c)(1),
(2) Date: Nov. 21, 2018

(87) PCT Pub. No.: WO2017/202621
PCT Pub. Date: Nov. 30, 2017

(65) Prior Publication Data

US 2020/0102192 A1 Apr. 2, 2020

(30) Foreign Application Priority Data

May 25, 2016 (EP) ..... 16171287

(51) Int. Cl.
*B66B 29/08* (2006.01)

(52) U.S. Cl.
CPC ..... *B66B 29/08* (2013.01)

(58) Field of Classification Search
CPC ..... B66B 29/08
USPC ..... 198/324
See application file for complete search history.

(56) References Cited

FOREIGN PATENT DOCUMENTS

| | | | |
|---|---|---|---|
| CN | 1223961 | A | 7/1999 |
| CN | 204643517 | U | 9/2015 |
| CN | 105502137 | A | 4/2016 |
| EP | 0 661 229 | B1 | 7/1995 |
| EP | 0885832 | A1 | 12/1998 |
| EP | 0 924 157 | B1 | 7/2003 |
| EP | 2431319 | A1 | 3/2012 |
| WO | WO 2009047146 | A1 | 4/2009 |

OTHER PUBLICATIONS

International Search Report and Written Opinion for International Application No. PCT/EP2017/061391 dated Jul. 25, 2017.

*Primary Examiner* — Gene O Crawford
*Assistant Examiner* — Lester Ill Rushin
(74) *Attorney, Agent, or Firm* — Knobbe Martens Olson & Bear LLP

(57) ABSTRACT

The application relates to a floor covering of an escalator or moving walkway. The floor covering has a floor covering support, a first covering element and at least one adjoining covering element. At least one device which predetermines a single-possible, correct installation position of the covering elements on the floor covering support is arranged between at least the first covering element and the adjoining covering element, wherein, in the correct installation position, the first covering element and the adjoining covering element are arranged to be flush with the floor covering support and, in an incorrect installation position, at least part of the adjoining covering element is arranged in a visibly protruding manner on the floor covering support due to the device.

14 Claims, 3 Drawing Sheets

FLOOR COVERING OF A PASSENGER CONVEYOR

TECHNICAL FIELD

The present invention relates to a planar floor covering for covering an entry region of a passenger conveyor, to a passenger conveyor equipped therewith, and to a method for equipping a passenger conveyor.

SUMMARY

Passenger conveyors such as escalators or moving walkways are generally used to convey persons or objects in an upright position along an inclined track on a step belt provided with steps, or along a horizontal track on a pallet belt provided with pallets. In this case, the steps or pallets are moved along the inclined or horizontal track by means of a conveyor such that a passenger can enter the passenger conveyor in a first entry region and step onto one of the steps or pallets in order to then be conveyed, together with said step or pallet, towards a second entry region located at the opposite end of the passenger conveyor, where the passenger can leave the passenger conveyor again.

In the entry regions at opposite ends of the step belt or pallet belt, a planar floor covering is generally used as flooring that can be walked on to cover the top of an opening in an underfloor space or region containing technical equipment of the passenger conveyor, for example, such that passengers can pass over the entry region towards the moving steps or pallets. In the underfloor spaces, a return shaft comprising return sprockets may be arranged at one end of the passenger conveyor, and a drive, the controller thereof and a drive train comprising a drive shaft and drive sprockets may be housed at the other end of the passenger conveyor, for example.

In this case, the floor covering can ensure as flush as possible a transition that can be walked on between, for example, a floor of the surrounding building and the step belt or pallet belt that is moving in the passenger conveyor. In addition, the floor covering may often be removable or hinged, in order to allow access to the space thereunder containing the components of the passenger conveyor received therein, so that said components can be repaired or serviced, for example.

EP 0 661 229 B1 discloses an angular frame that is connected to the structural parts of a passenger conveyor and is used as a floor covering support for a covering element. For a flush, seamless transition into the surrounding flooring, the angular frame is adjustable in the vertical and horizontal positions by means of nuts and bolts. In order to absorb the noise generated when people walk over the floor cover, the support surface of the angular frame is provided with a resilient profile, said resilient profile being connected to the horizontal leg of the angular profile of the angular frame in an interlocking manner.

Since, as explained above, the return region of the step belt of the escalator or of the pallet belt of the moving walkway is located in the underfloor space below the floor covering, the covering element has to be securely arranged on the floor covering support, such that, despite the force direction and the point of applied force of an external force acting on the covering element, said covering element does not under any circumstances slip, raise up or tilt on the floor covering support, or accidentally open up an opening leading to the space containing the technical equipment.

The problem addressed by the invention is to provide a floor covering that takes into account the above-mentioned requirements and largely rules out incorrect installation.

This problem is solved by a floor covering of an entry region of a passenger conveyor designed as an escalator or moving walkway. The floor covering has a floor covering support, a first covering element and at least one adjoining covering element. The opening in an underfloor space in the passenger conveyor can be closed at least by means of the first and the adjoining covering element supported on the floor covering support such that it is flush with the surrounding flooring that can be walked on. At least one device which predetermines a single-possible, correct installation position of the covering elements on the floor covering support is arranged at least in the region of the first covering element and the adjoining covering element. In the correct installation position, the first covering element and the adjoining covering element are arranged to be flush with the floor covering support. In an incorrect installation position, at least part of the adjoining covering element is arranged in a visibly protruding and therefore non-flush manner on the floor covering support due to the device. Flush thus means that, when correctly installed, the covering elements, together with the floor covering support and the surrounding floor, form a planar surface that can be walked on.

This is brought about by the device comprising a positioning element by means of which a correct position of the first covering element on the floor covering support and thus the correct installation position of the first covering element can be predetermined, it being possible to bring the positioning element into an interlocking operative connection with the floor covering support and/or with the first covering element by moving the first covering element on the floor covering support.

By at least part of the adjoining covering element visibly protruding, it is immediately obvious that the first covering element has not been correctly installed. The device thus indicates a hazardous situation even to laypersons, and forces the defect to be inspected and remedied. The device may be designed in various different ways to cause the adjoining covering element to visibly protrude when incorrectly installed. Depending on the design of the device, said device or parts thereof may for example be arranged on the floor covering support of the floor covering or on one of the covering elements.

In one embodiment of the invention, the device is positioned in a region between the first covering element and the adjoining covering element, and is arranged on the floor covering support by means of a fastening element. In order to cause the adjoining covering element to protrude in part when incorrectly installed, the device contains a lever latch comprising a first lever arm, a bearing and a second lever arm. The bearing is arranged on the first lever arm between the two lever arms and the positioning element. The second lever arm extends into the region of the adjoining covering element. In the correct installation position, the positioning element projects into a cut-out in the first covering element, the second lever arm being adjusted to the floor covering support and the adjoining covering element such that the adjoining covering element can be arranged on the floor covering support so as to be flush and therefore to adjoin in a planar manner, and without visibly protruding.

In an incorrect installation position, the positioning element stands on top of the first covering element that is placed on the floor covering support and holds the lever latch in a position pivoted about the bearing. In this position, the second lever arm projects beyond the support plane of the floor covering support such that the adjoining covering element that is placed on the floor covering support stands on top of the second lever arm, and therefore is raised by the floor covering support at least in part. This covering element protruding clearly indicates that the first covering element is not yet arranged in the correct position on the floor covering support, and for example its front edge is positioned too far onto the comb plate or, particularly seriously, its front edge is not supported on the comb plate.

Once the positioning element has found the cut-out in the first covering element by the first covering element moving linearly on the floor covering support, the lever latch pivots back, the positioning element projects into the cut-out and the second lever arm lowers, such that it is no longer protruding beyond the support plane of the floor covering support. The lever latch preferably pivots back on account of gravity, which is why the second lever arm is supposed to have a greater mass moment of inertia than the first lever arm. Of course, said lever latch can also be pivoted back by a torsion spring. The adjoining covering element can now be placed onto the floor covering support so as to be flush.

Another embodiment of the invention has a similar effect. In this embodiment, the device is arranged on the first covering element by means of a fastening element. As in the previously described embodiment, the device is also positioned in a region between the first covering element and the adjoining covering element. The second embodiment of the device also comprises a lever latch comprising a lever arm, a bearing and the positioning element arranged on the lever arm. The bearing is, however, arranged on a first lever arm end. In the correct installation position, the positioning element projects into a cut-out in the floor covering support and the second lever arm end is arranged in the region of the adjoining covering element.

In the correct installation position, the positioning element projects into a cut-out in the floor covering support, the lever arm being adjusted to the floor covering support and the adjoining covering element such that the adjoining covering element can be arranged on the floor covering support so as to be flush and therefore to adjoin in a planar manner, and without visibly protruding or projecting. In an incorrect installation position, the positioning element stands on top of the floor covering support and holds the lever latch in a position pivoted about the bearing. In this position, a second lever arm end projects beyond the support plane of the floor covering support such that the adjoining covering element that is placed on the floor covering support stands on top of the second lever arm end, and therefore is raised by the floor covering support at least in part. This covering element protruding clearly indicates that the first covering element is not yet arranged in the correct position on the floor covering support, and for example its front edge is positioned too far onto the comb plate or its front edge is not supported on the comb plate.

Once the positioning element has found the cut-out in the floor covering support by the first covering element moving linearly on the floor covering support, the lever latch pivots back, the positioning element projects into the cut-out and the second lever arm end lowers, such that it is no longer protruding beyond the support plane of the floor covering support. The adjoining covering element can now be placed onto the floor covering support so as to be flush.

Preferably, the position of the device relative to the floor covering support or to the first covering element can be set by the at least one fastening element. This can compensate for manufacturing tolerances between the cut-out and the comb plate. If the fastening element comprises a screw connection and other components, for example, a slot or the like can be provided in one of the components to be connected.

For example, as such a component, the fastening element may contain a bearing bracket, on which the bearing of the lever latch is pivotally or rotatably mounted. The above-mentioned slot may also be made in this bearing bracket.

In order to position the first covering element relative to the floor covering support with as little play as possible, a through-hole may be made in the first covering element and a cut-out may be made in the floor covering support, the positioning element extending into the cut-out and the through-hole in the correct installation position.

In order to make this yet more secure, a securing element, preferably a screw connection having a wing nut, may also be arranged between the floor covering support and the first covering element. Of course, the securing element may also be a latching device having a range of different designs. It may be a twist lock or a slide lock, for example. The latching device may also be combined with a lock, for example a cylinder lock. For example, a spring bolt comprising a latching tab may also be used, of which the bar is held so as to be projecting by means of a resilient element.

Preferably, the device may also comprise at least one sensor or switch by means of which the correct installation position or the incorrect installation position of the covering element can be monitored. In the simplest terms, this can be implemented by a pressure switch or a button that, for example, directly interrupts the supply of power to a drive motor or drive units of the passenger conveyor once the covering element is in an incorrect installation position or is defective. Of course, the covering element may also be monitored by means of a sensor that transmits corresponding signals to a controller of the passenger conveyor. This can then trigger appropriate measures, such as immediate braking (emergency stop) of the step belt or pallet belt.

Since the floor covering of a moving walkway or escalator usually extends over a very large area, the at least two covering elements can be very heavy. In order to make it easier for installers or maintenance personnel to handle said covering elements, the floor covering may have additional covering elements that are arranged on the floor covering support so as to rest on one another and adjoin one another. A device, which is assigned at least to the first covering element, is provided that forces the single-possible, correct installation position of said covering element.

It is assigned at least to the first covering element because the potential risk of a defective or incorrectly installed covering element may be different depending on its position in the order of covering elements that are placed down. For example, an incorrectly installed first covering element arranged on the floor covering support so as to adjoin the comb plate is a very high risk to a user because there are moving parts of the step belt or pallet belt below this first covering element which could immediately strike and seriously injure a person if they fell in. The covering element directly adjoining the first covering element may also be arranged in this hazardous region, which is why a corresponding device may also be provided or assigned for this region too.

By contrast, covering elements that are arranged on the floor covering support so as to be further away from the comb plate cover a less critical or less hazardous region of the underfloor space, in which the control box and other electrical equipment, lubricating equipment, hydraulic equipment and the like are arranged, for example. Of course, at least one device may be provided for each covering element. The individual covering elements may comprise connecting elements at the end faces, which face other covering elements when installed. Said connecting elements may be designed as tongues and grooves, for example.

A floor covering comprising a plurality of covering elements also has the advantage that only as many covering elements as necessary need to be removed when access to the space containing the technical equipment needs to be provided by removing the at least one covering element.

In order to make the at least partial protrusion of an incorrectly installed covering element yet more easily perceptible, at least one side face of the covering element may be provided with a signal color. Instead of or in combination with the signal color, the side face may also comprise at least one reflective element. Of course, for the same purpose, at least one lamp may also be provided on the side face, either on its own or in combination with a signal color and/or a reflective surface. The lamp may be continuously illuminated, or may be flashing. Preferably, the lamp is connected such that its power supply is interrupted as soon as the covering element is in the correct installation position. Alternatively, the lamp may be connected to the power source such that it is not illuminated or flashing in the incorrect installation position and is continuously illuminated when the covering element is arranged in the correct installation position on the floor covering support. In this case, it is advantageous for the light of the lamp to enter the entry region in order to illuminate and/or indicate to the user the direction in which the step belt or pallet belt is running.

When installing the floor covering according to the invention in an entry region of a passenger conveyor designed as an escalator or moving walkway, a device is first fastened to the first covering element or the floor covering support. The first covering element is then placed onto the floor covering support. The first covering element is then brought into an intended, correct installation position, at least by sliding, such that the positioning element of the device positions the first covering element relative to the floor covering support in an interlocking manner. In another step, the at least one adjoining covering element is arranged on the floor covering support so as to fit closely to the first covering element. At least one visual inspection is then made to ascertain whether at least part of the adjoining covering element is visibly protruding from the floor covering support.

Of course, the invention may not only be used in new escalators or moving walkways. For example, an existing floor covering may be replaced with a floor covering according to the invention, and thus an existing moving walkway has been modernized. Of course, it is also possible to add at least one device to an existing floor covering, such that a single-possible, correct installation position on the floor covering support is predetermined, wherein, when correctly installed, the adjoining covering element is arranged to be flush or so as to form a planar surface that can be walked on together with the floor covering support and the surrounding floor, and, when incorrectly installed, at least part of the covering element adjoining the first covering element is arranged in a visibly protruding manner on the floor covering support due to the device.

BRIEF DESCRIPTION OF THE DRAWINGS

The floor covering comprising a device which predetermines a single-possible, correct installation position of the first covering element on the floor covering support will be explained in greater detail in the following on the basis of examples and with reference to the drawings, the same reference signs being used throughout in all the figures for identical components. In the drawings.

DETAILED DESCRIPTION

Figure 1:
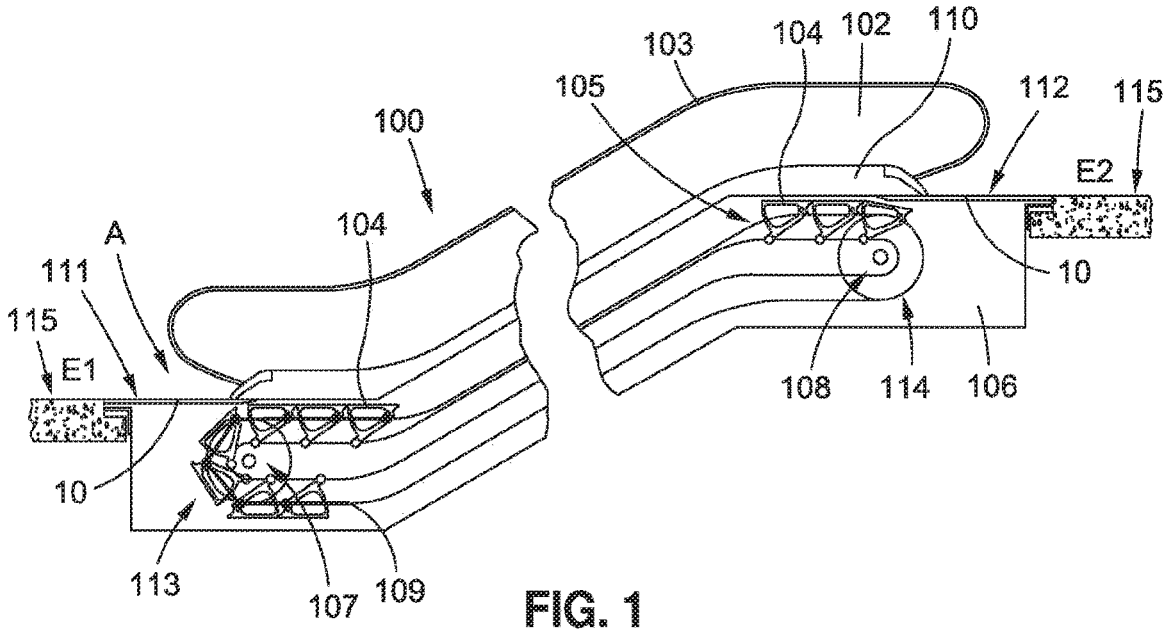
FIG. 1 is a schematic view of an escalator having a support structure or framework and two return regions, running rails being arranged in the support structure and a revolving step belt being arranged between the return regions.

FIG. 1 is a schematic side view of a passenger conveyor 100 which is designed as an escalator and which connects a first floor E1 to a second floor E2. The passenger conveyor 100 comprises a support structure 106 or framework 106 comprising two return regions 107, 108, between which a step belt 105, which is only shown in part, is guided so as to revolve. The step belt has pulling means 109 on which steps 104 are arranged. A handrail 103 is arranged on a balustrade 102. The balustrade 102 is connected to the support structure 106 at the lower end by means of a balustrade base 110. The passenger conveyor 100 and the step belt 105 thereof can be accessed via entry regions 111, 112 at either end of the passenger conveyor 100. The surfaces of the entry regions 111, 112 that can be walked on are floor coverings 10 that each close the opening in an underfloor space 113, 114 in the passenger conveyor 100 from the surrounding flooring 115, which can be walked on, of the floors E1, E2 in a flush or planar manner Of course, the passenger conveyor 100 could also be designed as a moving walkway, with a pallet belt being arranged so as to revolve instead of a step belt, the middle part of said pallet belt not having any inclination or having less of an inclination than an escalator.

Figure 2:
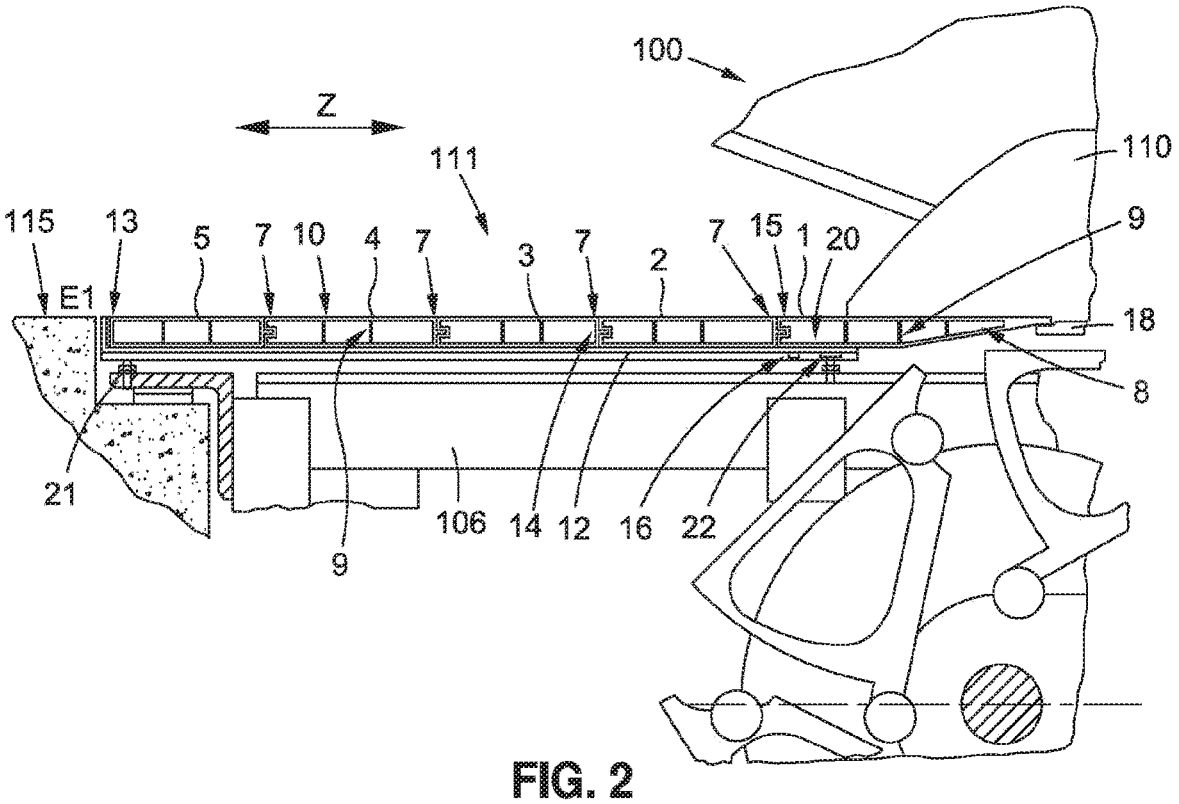
FIG. 2 is an enlarged view of the detail of an entry region denoted A in FIG. 1, and shows details of a floor covering that covers the associated return region more clearly.

FIG. 2 is an enlarged view of the detail of the entry region 111, denoted "A" in FIG. 1 and arranged in the floor E1, and shows details of the floor covering 10 more clearly. The floor covering 10 shown in cross section comprises a plurality of covering elements 1, 2, 3, 4, 5. The first covering element 1, arranged in the region of the balustrade base 110 on the right in FIG. 2, is designed as a hollow profile having transverse supports 9, and the tapering right-hand side 8 of said covering element rests on a comb plate 18 that is part of a securing apparatus. The left-hand side of said covering element ends in a joint 7. The covering element 2 that adjoins on the left is designed in cross section as a rectangular hollow profile having transverse supports 9, and the other adjoining covering elements 3 to 5 are likewise identically designed as hollow profiles having rectangular cross sections and transverse supports 9. The end faces of the covering elements 1 to 5 may be interconnected at the joints 7 by means of appropriate connecting elements 14, such as tongues and grooves. The left-hand end faces of the covering elements 1 to 5 for example comprise a groove and the right-hand end faces of the covering elements 2 to 5 comprise a tongue. A floor covering support 12 designed as an angular frame is fastened to the support structure 106 by means of adjustment screws 21, 22, such that the floor covering support 12 can be leveled to the plane of the surrounding flooring 115, which can be walked on, of the floor E1. The floor covering support 12 may be a frame constructed from angular profiles. These angular profiles may be made of sheet steel, which is cut from a steel sheet in a punching process and is bent to form angular profiles. The floor covering support 12 caps off the floor covering 10 at two longitudinal sides (covered by the floor covering), which extend in the entry direction Z, and one transverse side 13. All the covering elements 1 to 5 are shown in their correct installation positions.

When installing the floor covering 10, the installer or maintenance personnel must take particular care to ensure that the tapering side 8 of the first covering element 1 rests securely on the comb plate 18. In order to prevent slipping and tilting, the first covering element 1 is rigidly connected to the floor covering support 12 by means of a securing element 16 in the region of the left-hand end face 15 of said covering element. The securing element 16 may be a screw connection 16, for example Since this securing element 16 is not visible when the floor covering 10 is fully installed, it may also not be noticed if the nut of the screw connection 16 is missing due to an installation error.

In order to prevent this situation from arising, the present invention provides that the floor covering 10 contains at least one device 20 by means of which a single-possible, correct installation position of the at least one covering element 1 to 5 on the floor covering support 12 is predetermined. Correct installation is signaled by the covering elements 1 to 5 being arranged flush with the floor covering support 12. If incorrectly installed, at least part of the covering element 2 adjoining the first covering element 1 is arranged in a visibly protruding manner on the floor covering support 12 due to the device 20.

The device 20 and its arrangement in the floor covering 10 may be designed in various different ways. Possible embodiments are described in the following.

Figure 3:
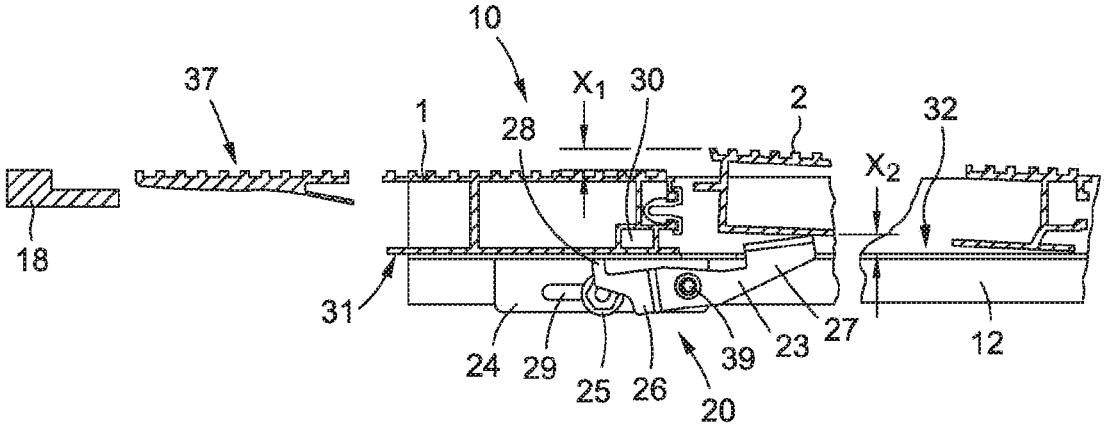
FIG. 3 is a sectional side view of an embodiment of a floor covering comprising a first covering element and at least one adjoining covering element, the floor covering comprising a device having a dual-arm lever latch and the first covering element being shown in an incorrect installation position.
Figure 4:
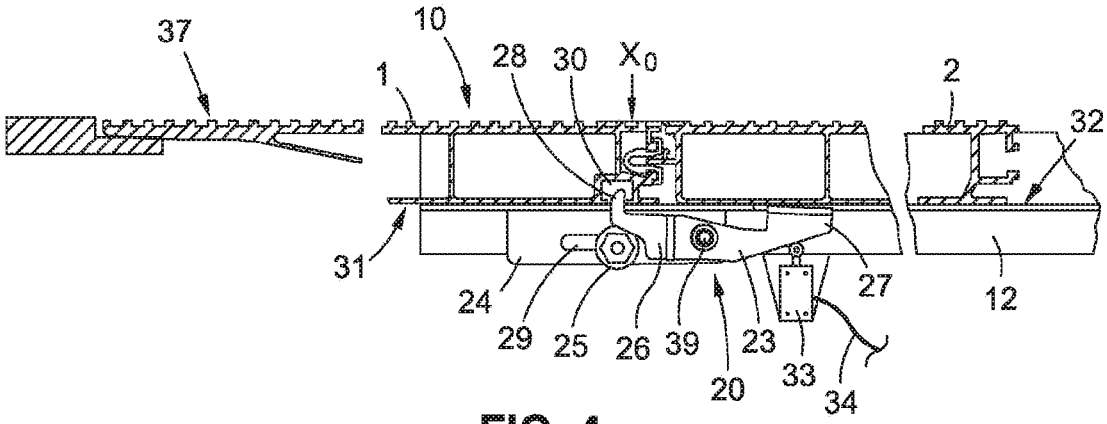
FIG. 4 shows the embodiment from FIG. 3, with the first covering element being shown in the correct installation position, and the correct installation position of the first covering element being monitored by a sensor or switch.
Figure 5:
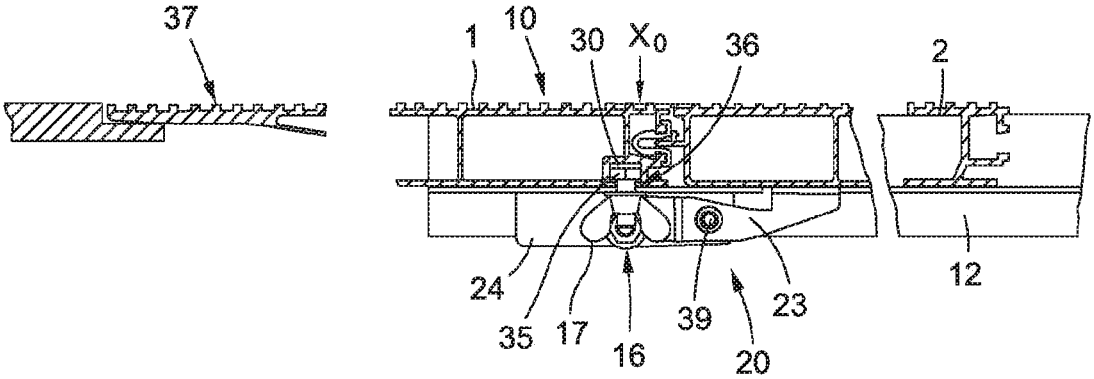
FIG. 5 shows the embodiment from FIG. 3, with the first covering element being fastened in the correct installation position by means of an additional fastening element.
Figure 6:
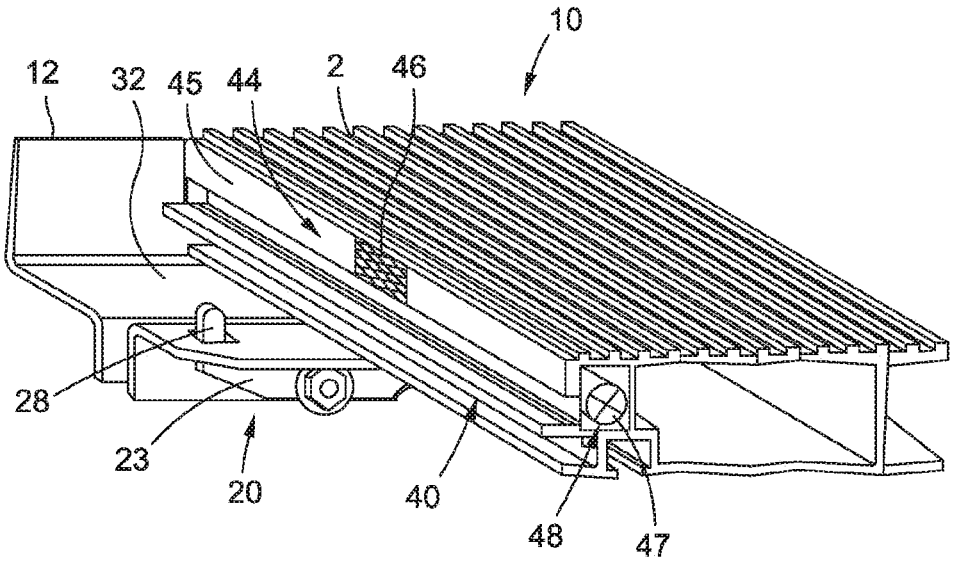
FIG. 6 is a three-dimensional view of the embodiment from FIG. 3, with only the adjoining covering element being shown in FIG. 6 so as to show the signaling elements thereof.

FIGS. 3 to 5 are sectional side views and FIG. 6 is a three-dimensional view of a detail of an embodiment of a floor covering 10 comprising a device 20, as mentioned in conjunction with FIG. 2. FIG. 3 shows the part of the floor covering 10 denoted as the first covering element 1 in FIG. 2 in the incorrect installation position $X_1$. As already described, the first covering element 1 being insufficiently or defectively supported on the comb plate 18 poses a serious risk.

In order to indicate the incorrect installation position $X_1$ and thus the potential risk, the floor covering 10 comprises the device 20, which comprises a dual-arm lever latch 23, a bearing bracket 24 and a fastening element 25. On the bearing bracket 24, the dual-arm lever latch 23 is pivotally mounted on a bearing 39. A positioning element 28 integrally formed as a protrusion is arranged on the first lever arm 26 of said lever latch. The bearing bracket 24 is fastened to the floor covering support 12 by means of the fastening element 25. In the present embodiment, the fastening element 25 is a screw connection. In order to adjust the position of the device 20 relative to the floor covering support 12, the bearing bracket 24 comprises a slot 29. The distance of the positioning element 28 from the comb plate 18 is adjusted such that the first covering element 1 rests securely on the comb plate 18 in the correct installation position $X_0$, as shown in FIGS. 4 and 5.

The first covering element 1 comprises a cut-out 30. When the first covering element 1 is placed onto the floor covering support 12, the underside 31 stands on top of the positioning element 28, as shown in FIG. 3, and the lever latch 23 pivots into the position shown. The second lever arm 27 of said lever latch projects beyond the support plane 32 of the floor covering support 12 by a height $X_2$. If an adjoining covering element 2 is then placed onto the floor covering support 12 without correcting the position of the first covering element 1, said adjoining covering element 2 will rest on the second lever arm 27 and be held in a visibly protruding position, or so as to indicate the incorrect installation position $X_1$. This makes it immediately obvious to anyone that the first covering element 1 is in an incorrect installation position $X_1$.

In the embodiment shown in FIG. 3, the first covering element 1 can then be brought into the correct installation position $X_0$ by moving the first covering element on the floor covering support 12 in the direction of the comb plate 18. This is then achieved when the protrusion 28 can engage in the cut-out 30 in an interlocking manner Since the protrusion 28 can project into the cut-out 30, the lever latch 23 can pivot back, as shown in FIG. 4. In this position, the second lever arm 27 no longer projects beyond the support plane 32, and therefore the adjoining covering element 2 can be flush with the floor covering support 12.

It is particularly advantageous for an incorrectly installed covering element 1 to 5 of the floor covering 10 to directly affect the operating state of the passenger conveyor 100. To achieve this, as shown in FIG. 4, the correct installation position $X_0$ of the covering element 1 to 5 can be monitored by a sensor 33 or a switch 33. The sensor 33 can mechanically or optically detect the position of the lever latch 23, for example A simple switch 33 can be used for this purpose which, for example, directly interrupts the supply of power to a drive motor (not shown) of the step belt 105 or pallet belt once the lever latch 23 is pivoted due to an incorrect installation position $X_1$.

Alternatively, the switch 33 or sensor 33 can transmit a signal corresponding to the installation position of the covering element 1 to 5 to a controller (not shown) of the passenger conveyor 100 via a signal line 34, for example, such that the controller immediately initiates or maintains the stoppage of the step belt 105 or pallet belt in the incorrect installation position $X_1$ and enables operation relative to the floor covering 10 in the correct installation position $X_0$.

The covering element 2 may additionally be secured in the correct installation position $X_0$ by means of a securing means 16, as shown in FIG. 5. The securing means 16 in the embodiment shown comprises a bolt 35 and a wing but 17. The bolt 35 is embedded in the cut-out 30 in the first covering element 1 and projects through a through-hole 36 in the bearing bracket 24 in the correct installation position $X_0$. The wing nut 17 of the securing means 16 is installed and tightened so as to fit closely, as shown in FIG. 4. The upper surface of the first covering element 1, which can be walked on and is provided with a ribbed profile 37, is flush ($X_0$=0) with the surface of the adjoining covering element 2, which can be walked on and is arranged on the floor covering support 12 so as to be adjacent to the correctly installed first covering element 1.

Of course, a latching device, such as a spring bolt or a bar, which is fastened to the floor covering support 12 and engages in a cut-out in the first covering element 1, may also be used as a securing means 16.

FIG. 6 is a three-dimensional view of a detail of the embodiment from FIG. 3, with only the adjoining covering element 2 being shown in FIG. 6 so as to show the signaling elements 40 thereof. In order to make the at least partial protrusion of an incorrectly installed covering element 1 to 5 yet more easily perceptible, as shown with reference to the adjoining covering element 2, at least one side face 44 of the adjoining covering element 2 may be provided with a signal color 45 such as neon yellow, neon orange or the like.

Instead of or in combination with the signal color 45, the side face 44 may also comprise at least one reflective element 46. Of course, at least one lamp 47 may also be provided on the side face 44 for the same purpose, as shown schematically by the light fitting 47 arranged in a glazed groove 48. The lamp 47 may be used either on its own or in combination with a signal color 45 and/or a reflective element 46.

FIG. 6 also clearly shows how the positioning element 28 projects beyond the support plane 32 of the floor covering support 12, such that the lever latch 23 is actuated and the adjoining covering element 2 is raised when, as shown in FIG. 3, the cut-out 30 in the first covering element 1 is not arranged at this point.

Figure 7:
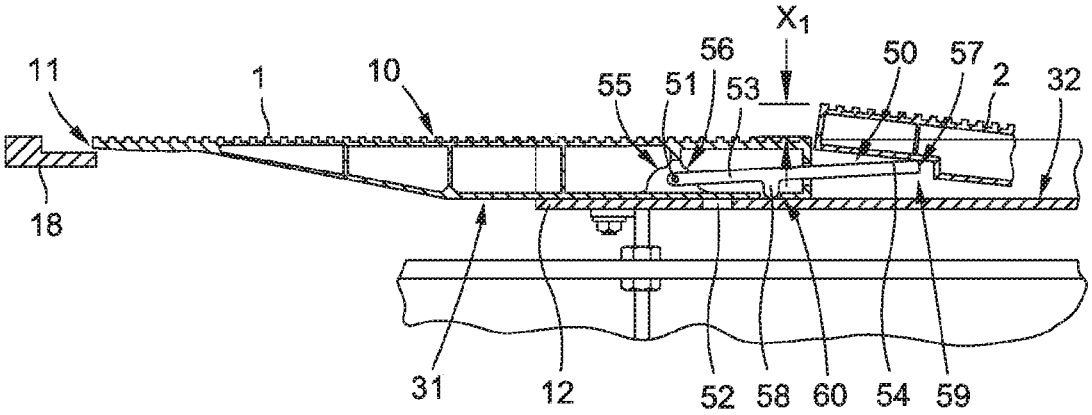
FIG. 7 is a sectional side view of another embodiment of a floor covering comprising a first covering element and at least one adjoining covering element, the floor covering comprising a device having a single-arm lever latch and the first covering element being shown in an incorrect installation position.

FIG. 7 is a sectional side view of a floor covering 10 in another embodiment of the invention, with the first covering element 2 being in the incorrect installation position $X_1$. In this embodiment, a device 50 is arranged on the first covering element 1 by means of a fastening element 51. As in the previously described embodiment, the device 50 is also positioned in a region between the first covering element 1 and the adjoining covering element 2. This embodiment of the device 50 also comprises a lever latch 53 comprising a lever arm 54, a bearing 55 and the positioning element 58 arranged on the lever arm 54. The bearing 55 is, however, arranged on a first lever arm end 56. The second lever arm end 57 is arranged in the region of the adjoining covering element 2. Furthermore, the floor covering support comprises a cut-out 52.

In an incorrect installation position $X_1$, the positioning element 58 stands on top of the floor covering support 12 and holds the lever latch 53 in a position pivoted about the bearing 55. In this position, the second lever arm end 57 projects far beyond the support plane 32 of the floor covering support 12 such that the adjoining covering element 2 that is placed on the floor covering support 12 stands on top of the second lever arm end 57, and therefore is raised by the floor covering support 12 at least in part. This covering element protruding clearly indicates that the first covering element 1 is not yet arranged in the correct position on the floor covering support 12, and for example its front edge 11 is positioned too far onto the comb plate 18 or, as shown in FIG. 7, its front edge 11 is not supported on the comb plate 18.

Once the positioning element 58 has found the cut-out 52 in the floor covering support 12 by the first covering element 1 moving linearly on the floor covering support 12, the lever latch 53 pivots back, the positioning element 58 projects into the cut-out 52 and the second lever arm end 57 lowers, such that it is no longer protruding beyond the support plane 32 of the floor covering support 12. The adjoining covering element 2 comprises a clearance 59 so that the lever latch 53 that has pivoted back has enough space and the adjoining covering element 2 can be flush with the floor covering support 12.

Since the bearing 55, part of the lever latch 53 and in particular the positioning element 58 are arranged within the first covering element 1, a through-hole 60 is made in the underside 31 of the first covering element 1 in the region of the positioning element 58. When the first covering element 1 is in the correct installation position $X_0$, the positioning element 58 project through both the through-hole 60 and the cut-out 52. As a result, positioning with very little play can be achieved, since the interlocking is produced by the positioning element 58, the through-hole 60 and the cut-out 52, and not the bearing 51.

Although the invention has been described on the basis of specific embodiments, it is clear that countless additional variants can be produced within the context of the present invention, for example by a sensor 25 or switch 25 being used in each of the variants to monitor the correct installation of the first covering element 1. Furthermore, the floor covering 10 may also comprise a plurality of device 20, 50. All the embodiments may also be used in floor coverings 10 that comprise more than two covering elements 1 to 5. In floor coverings 10 of this type, at least one device 20, 50 may be provided for each of the covering elements 1 to 5. Of course, it is also possible for the second lever 27 of the lever latch 23 to extend behind the covering element 2 directly adjoining the first covering element 1, such that an adjoining covering element 3, 4, 5 other than the covering element 2 directly adjoining the first covering element 1 is raised in the incorrect installation position $X_1$.

Of course, existing passenger transport systems 100 can also be modernized by the existing floor coverings 10 thereof being replaced with floor coverings 10 according to the invention or by corresponding devices 20, 50 being added to the existing floor coverings 10.

The invention claimed is:

1. A floor covering of an entry region of a passenger conveyor designed as an escalator or a moving walkway, the floor covering comprising:

a floor covering support, a first covering element and at least one adjoining covering element configured to close an opening in an underfloor space in the passenger conveyor at least with the first covering element and the at least one adjoining covering element supported on the floor covering support such that it is flush with the surrounding flooring that can be walked on, at least one device which predetermines a single-possible, correct installation position of the first covering element and the at least one adjoining covering elements on the floor covering support arranged at least in the region of the first covering element and the at least one adjoining covering element the at least one device configured such that, in the correct installation position, the first covering element and the at least one adjoining covering element are arranged flush with the floor covering support and, in an incorrect installation position, at least part of the at least one adjoining covering element is arranged in a visibly protruding manner on the floor covering support due to the at least one device, wherein the at least one device comprises a positioning element configured to be brought into an interlocking operative connection with the floor covering support or with the first covering element by moving the first covering element on the floor covering support.

2. The floor covering according to claim 1, wherein the at least one device is positioned in a region between the first covering element and the at least one adjoining covering element, and is arranged on the floor covering support with a fastening element, and the at least one device comprises a lever latch comprising a first lever arm, a bearing and a second lever arm, the bearing arranged between the two lever arms, the positioning element arranged on the first lever arm, wherein the positioning element projects into a cut-out in the first covering element in the correct installation position, and the second lever arm extends in the region of the adjoining covering element.

3. The floor covering according to claim 1, wherein the at least one device is positioned in a region between the first covering element and the at least one adjoining covering element, and is arranged on the first covering element with a fastening element, and the at least one device comprises a lever latch comprising a lever arm, a bearing and the positioning element arranged on the lever arm, the bearing arranged on a first lever arm end, the positioning element projecting into a cut-out the floor covering support in the correct installation position, and the second lever arm end arranged in the region of the adjoining covering element.

4. The floor covering according to claim 2, wherein the position of the at least one device relative to the floor covering support or to the first covering element can be set by the at least one fastening element.

5. The floor covering according to claim 2, wherein the fastening element comprises a bearing bracket on which the bearing of the lever latch is pivotally or rotatably mounted.

6. The floor covering according to claim 1, wherein first covering element comprises a through-hole and the floor covering support comprises a cut-out, and the positioning element extends into the cut-out and the through-hole in the correct installation position.

7. The floor covering according to claim 1, wherein a securing element is arranged between the floor covering support and the first covering element.

8. The floor covering according to claim 1, wherein the at least one device comprises at least one sensor or switch configured to monitor the correct installation position or the incorrect installation position of the covering elements.

9. The floor covering according to claim 1, wherein said floor covering comprises a plurality of covering elements, which are arranged on the floor covering support so as to rest on one another in an adjoining manner, and at least one device is assigned at least to the first covering element.

10. The floor covering according to claim 1, wherein access can be provided to the underfloor space containing the technical equipment by removing at least one of the covering elements.

11. The floor covering according to claim 1, wherein at least one side face of the at least one adjoining covering element is provided with at least one of a signal color, at least one reflective element, or with at least one lamp.

12. A method for correctly installing a floor covering according to claim 1, of an entry region of a passenger conveyor designed as an escalator or moving walkway, the method comprising:

during installation, fastening the at least one device to the first covering element or to the floor covering support, placing the first covering element onto the floor covering support, bringing the first covering element into an intended, correct installation position, at least by sliding, such that the positioning element of the device positions the first covering element relative to the floor covering support in an interlocking manner, arranging the at least one adjoining covering element on the floor covering support so as to fit closely to the first covering element, and making at least one visual inspection to ascertain whether at least part of the adjoining covering element is visibly protruding from the floor covering support.

13. A method for modernizing a passenger conveyor designed as an escalator or moving walkway, at least one device is added to the existing floor covering in at least one of the entry regions of the existing escalator or moving walkway, such that this addition produces a floor covering according to claim 1.

14. The floor covering to claim 7, wherein the securing element comprises a screw connection having a wing nut.

* * * * *